US011267684B2

(12) United States Patent
Cacciatore et al.

(10) Patent No.: US 11,267,684 B2
(45) Date of Patent: Mar. 8, 2022

(54) LIQUID FILLING SYSTEM AND METHOD OF USING SAME

(71) Applicant: The Procter & Gamble Company, Cincinnati, OH (US)

(72) Inventors: Justin Thomas Cacciatore, Cincinnati, OH (US); Sebastian Vargas, Cincinnati, OH (US); Scott William Capeci, North Bend, OH (US); Eric Shawn Goudy, Liberty Township, OH (US); Hua Hu, Cincinnati, OH (US); Boon Ho Ng, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/436,986

(22) Filed: Jun. 11, 2019

(65) Prior Publication Data

US 2019/0389708 A1 Dec. 26, 2019

(30) Foreign Application Priority Data

Jun. 22, 2018 (WO) ..... PCT/CN2018/092339

(51) Int. Cl.

| | |
|---|---|
| ***B67C 3/02*** | (2006.01) |
| ***B01F 3/08*** | (2006.01) |
| ***B65B 3/30*** | (2006.01) |
| ***B65B 39/00*** | (2006.01) |

(52) U.S. Cl.

CPC ..... *B67C 3/023* (2013.01); *B01F 3/0865* (2013.01); *B65B 3/30* (2013.01); *B65B 39/00* (2013.01); *B65B 2039/009* (2013.01)

(58) Field of Classification Search

CPC ..... B67C 3/023; B01F 3/0865; B65B 3/30; B65B 39/00; B65B 2039/009

See application file for complete search history.

(56) References Cited

U.S. PATENT DOCUMENTS

| | | | | |
|---|---|---|---|---|
| 2,887,133 | A * | 5/1959 | Breeback | B67C 3/262 141/44 |
| 4,022,379 | A | 5/1977 | Ladisch | |
| 4,218,014 | A | 8/1980 | Tracy | |
| 4,388,338 | A * | 6/1983 | Wittenborg | A23F 5/26 141/102 |
| 4,392,588 | A * | 7/1983 | Scalera | G07F 13/10 222/129.4 |

(Continued)

FOREIGN PATENT DOCUMENTS

| | | | |
|---|---|---|---|
| CA | 1098058 | A | 3/1981 |
| DE | 690574 | C | 4/1940 |

(Continued)

OTHER PUBLICATIONS

PCT Search Report for appl. No. PCT/CN2018/092087, dated Mar. 21, 2019, 6 pages.

(Continued)

*Primary Examiner* — Timothy L Maust
(74) *Attorney, Agent, or Firm* — Carrie Schwartz

(57) ABSTRACT

A liquid filling system is provided that contains a container and a nozzle, while such nozzle contains liquid flow passages that are configured to generate different liquid influxes that are directed differentially toward the bottom and the sidewall(s) of such containers.

14 Claims, 7 Drawing Sheets

(56) References Cited

U.S. PATENT DOCUMENTS

| | | | | | |
|---|---|---|---|---|---|
| 4,512,379 | A * | 4/1985 | Hennig | B65B 3/22 | 141/286 |
| 4,711,277 | A * | 12/1987 | Clish | B65B 3/22 | 141/311 A |
| 4,753,370 | A * | 6/1988 | Rudick | B67D 1/0051 | 222/105 |
| 4,834,545 | A | 5/1989 | Inoue et al. | | |
| 4,928,854 | A | 5/1990 | Mccann et al. | | |
| 5,033,651 | A | 7/1991 | Whigham | | |
| 5,129,551 | A * | 7/1992 | Gott | B05B 9/03 | 222/135 |
| 5,203,474 | A | 4/1993 | Haynes | | |
| 5,339,874 | A * | 8/1994 | Cragun | B67C 3/06 | 141/9 |
| 5,419,348 | A * | 5/1995 | Kuta | B08B 9/32 | 134/144 |
| 6,076,750 | A * | 6/2000 | Mykkanen | B65B 39/00 | 141/311 A |
| 6,173,862 | B1 | 1/2001 | Buca | | |
| 6,401,981 | B1 | 6/2002 | Mccann et al. | | |
| 6,402,841 | B1 | 6/2002 | Vesterlund et al. | | |
| 6,415,991 | B1 | 7/2002 | Eriksson | | |
| 6,533,195 | B2 | 3/2003 | Sinders | | |
| 6,837,228 | B2 | 1/2005 | Baasch | | |
| 6,991,004 | B2 * | 1/2006 | Kaufhold | B01F 13/1055 | 141/104 |
| 7,226,631 | B2 * | 6/2007 | Thakur | A23F 5/405 | 426/477 |
| 7,358,457 | B2 | 4/2008 | Peng | | |
| 7,559,346 | B2 | 7/2009 | Herrick et al. | | |
| 7,918,435 | B2 | 4/2011 | Page | | |
| 8,025,792 | B2 | 9/2011 | Delesdernier et al. | | |
| 9,073,023 | B2 | 7/2015 | Bernard | | |
| 9,114,417 | B2 * | 8/2015 | Sakamoto | B05C 3/10 | |
| 9,233,484 | B2 | 1/2016 | Larson | | |
| 9,505,506 | B2 | 11/2016 | Ammann | | |
| 9,849,470 | B1 * | 12/2017 | Yattara | B67C 3/26 | |
| 10,507,479 | B2 | 12/2019 | Bertness et al. | | |
| 10,814,291 | B2 * | 10/2020 | Chen | B65B 3/04 | |
| 2005/0058748 | A1 | 3/2005 | Bourguignon | | |
| 2005/0092386 | A1 | 5/2005 | Kaufhold et al. | | |
| 2008/0245282 | A1 | 10/2008 | Richards | | |
| 2009/0039180 | A1 | 2/2009 | Lukasiewicz | | |
| 2011/0200718 | A1 | 8/2011 | Swertvaegher | | |
| 2013/0105041 | A1 | 5/2013 | Krulitsch et al. | | |
| 2014/0263760 | A1 | 9/2014 | Hanna | | |
| 2015/0283565 | A1 | 10/2015 | Strand | | |
| 2016/0228891 | A1 | 8/2016 | Rosko | | |
| 2017/0312707 | A1 | 11/2017 | Park | | |
| 2017/0348707 | A1 | 12/2017 | Yattara | | |
| 2018/0036752 | A1 | 2/2018 | Breingan | | |
| 2018/0168185 | A1 | 6/2018 | Moreau | | |
| 2018/0353914 | A1 | 12/2018 | Ng | | |
| 2018/0353915 | A1 | 12/2018 | Chen | | |
| 2018/0354767 | A1 | 12/2018 | Cacciatore et al. | | |
| 2018/0354769 | A1 | 12/2018 | Cacciatore et al. | | |
| 2018/0354770 | A1 | 12/2018 | Cacciatore et al. | | |
| 2018/0355290 | A1 | 12/2018 | Capeci | | |
| 2018/0357759 | A1 | 12/2018 | Zonfrilli | | |
| 2019/0389709 | A1 | 12/2019 | Cacciatore et al. | | |

FOREIGN PATENT DOCUMENTS

| | | | |
|---|---|---|---|
| EP | 2490949 | B1 | 8/2016 |
| ER | 2650253 | A1 | 10/2013 |
| GB | 2256636 | A | 12/1992 |
| GB | 2269761 | B | 12/1995 |
| JP | 2007156998 | A | 6/2007 |
| JP | 3134790 | B2 | 8/2007 |
| KR | 20140069844 | A | 6/2014 |
| WO | WO2011049505 | A4 | 7/2011 |
| WO | 2017060453 | A1 | 4/2017 |

OTHER PUBLICATIONS

PCT Search Report for appl. No. PCT/CN2018/092339, dated Mar. 22, 2019, 5 pages.

EP Search Report, appl. No. 19181821.0-1105, dated Nov. 22, 2019, 6 pages.

All Office Actions, U.S. Appl. No. 16/436,967.

All Office Actions, U.S. Appl. No. 17/376,605.

Unpublished U.S. Appl. No. 17/376,605, filed Jul. 15, 2021, to Justin Thomas Cacciatore et. al.

* cited by examiner

LIQUID FILLING SYSTEM AND METHOD OF USING SAME

FIELD OF THE INVENTION

The present invention relates to a liquid filling system for filling a container with liquid compositions, especially at a relatively high filling speed, as well as method of using such a liquid filling system for in situ mixing of two or more liquid compositions inside the container.

BACKGROUND OF THE INVENTION

Traditional industry-scale methods for forming liquid consumer products (e.g., liquid laundry detergents, liquid fabric care enhancers, liquid dish-wash detergents, liquid hard-surface cleaners, liquid air fresheners, shampoos, conditioners, body-wash liquids, liquid hand soaps, liquid facial cleansers, liquid facial toners, moisturizers, and the like) involve mixing multiple raw materials of different colors, density, viscosity, and solubility in large quantities (e.g., through either batch mixing or continuous in-line mixing) to first form a homogenous and stable liquid composition, which is then filled into individual containers, followed subsequently by packaging and shipping of such containers. Although such traditional methods are characterized by high throughput and satisfactory mixing, the nevertheless suffer from lack of flexibility. If two or more different liquid consumer products need to be made using the same production line, the production line needs to be cleaned or purged first before it is used to make a different liquid consumer product. Such cleaning or purging step also generates a significant amount of "waste" liquid that cannot be used in either product.

In order to provide more flexible industry-scale methods for forming liquid consumer products, it may be desirable to conduct in situ mixing of two or more different liquid compositions inside a container. However, when such two or more liquid compositions are significantly different in viscosity, solubility, and/or miscibility, it may be difficult to form stable and homogeneous mixtures that meet the standards for consumer products. Further, if one of the liquid compositions tends to form hard-to-remove residues on the interior surfaces of the container, the mixing result can be further compromised.

There is therefore a continuing need for liquid filling systems and methods that can be used for high-speed, industry-scale in situ mixing of two or more different liquid compositions inside a container to form liquid consumer products that are well mixed with satisfactory homogeneity and stability.

SUMMARY OF THE INVENTION

The present invention meets the above-mentioned needs by providing a liquid filling system, which comprises:

a) a container comprising a bottom, a top, one or more sidewalls between the bottom and the top, and an opening at the top of the container;

b) a nozzle for filling the container with a liquid through the opening at the top of the container, while the nozzle comprises one or more first liquid flow passages and one or more second liquid flow passages, while such one or more first liquid flow passages are configured to generate one or more first liquid influxes that are directed toward the bottom of the container, while such one or more second liquid flow passages are configured to generate one or more second liquid influxes that are directed toward the sidewall(s) of the container.

In another aspect, the present invention provides a method of filling a container with liquid compositions, comprising the steps of:

(A) providing a container comprising a bottom, a top, one or more sidewalls between the bottom and the top, and an opening at the top of the container;

(B) providing a first liquid feed composition and a second liquid feed composition that is different from the first liquid feed composition in viscosity, solubility, and/or miscibility;

(C) partially filling the container with the first liquid feed composition to from 0.01% to 50% of the total volume of the container; and (D) subsequently, filling the remaining volume of the container, or a portion thereof, with the second liquid feed composition, wherein during step (D), the second liquid feed composition is filled into the container through a nozzle, while the nozzle comprises one or more first liquid flow passages and one or more second liquid flow passages, while the one or more first liquid flow passages are configured to generate one or more first liquid influxes that are directed toward the bottom of the container, wherein said one or more second liquid flow passages are configured to generate one or more second liquid influxes that are directed toward the sidewall(s) of the container.

Preferably, the nozzle comprises a plurality of the first liquid flow passages configured to generate a plurality of the first liquid influxes directed at different regions of the bottom of the container.

Further, the nozzle may comprise a plurality of the second liquid flow passages configured to generate a plurality of said second liquid influxes directed at different regions of the sidewall(s) of the container. More preferably, the different regions of the sidewall(s) comprises at least a first region and a second region, while the first region is closer to the bottom of the container than the second region. Furthermore, the container further comprises a through handle that connects one sidewall of the container (e.g., a front sidewall) with another sidewall thereof (e.g., a back sidewall), and while the different regions of the sidewall(s) comprises a region that is on or adjacent to the through handle of the container.

In a particularly preferred but not necessary embodiment of the present invention, the cross-sectional area ratio between each of said one or more first liquid flow passages and each of said one or more second liquid flow passages is from 1 to 10, preferably from 2 to 8, more preferably from 3 to 7, most preferably from 4 to 6.

These and other aspects of the present invention will become more apparent upon reading the following detailed description of the invention.

DETAILED DESCRIPTION OF THE INVENTION

Figure 1:
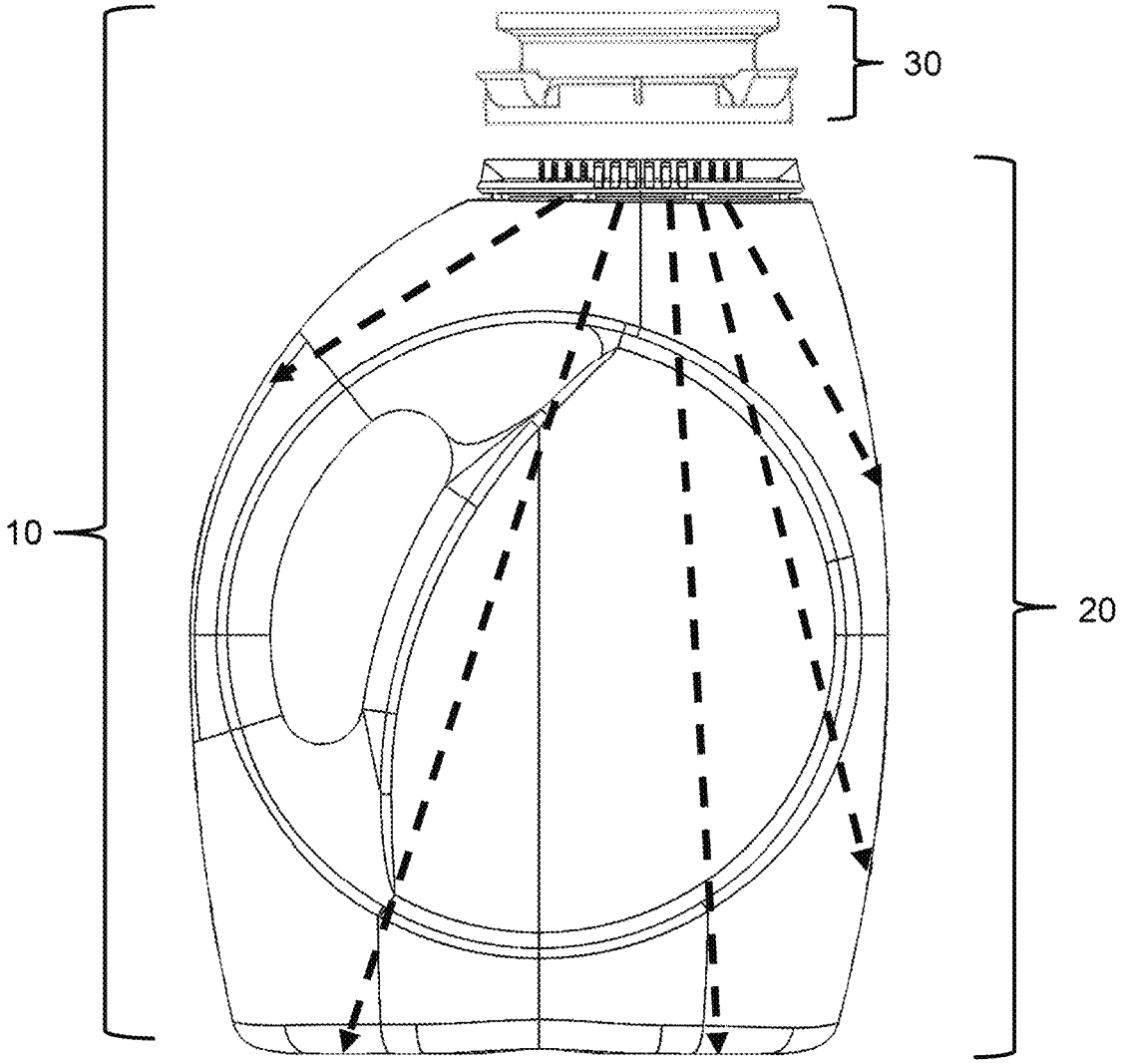
FIG. 1 is an illustrative view of a liquid filling system including a container and a nozzle, according to one embodiment of the present invention.

Features and benefits of the various embodiments of the present invention will become apparent from the following description, which includes examples of specific embodiments intended to give a broad representation of the invention. Various modifications will be apparent to those skilled in the art from this description and from practice of the invention. The scope of the present invention is not intended to be limited to the particular forms disclosed and the invention covers all modifications, equivalents, and alternatives falling within the spirit and scope of the invention as defined by the claims.

As used herein, articles such as "a" and "an" when used in a claim, are understood to mean one or more of what is claimed or described. The terms "comprise," "comprises," "comprising," "contain," "contains," "containing," "include," "includes" and "including" are all meant to be non-limiting.

As used herein, the term "in situ" refers to real-time mixing that occurs inside a container (e.g., a bottle or a pouch) that is designated for housing a finished liquid consumer product (e.g., a liquid laundry detergent, a liquid fabric care enhancer, a liquid dish-wash detergent, a liquid hard-surface cleaner, a liquid air freshener, a shampoo, a conditioner, a liquid body-wash, a liquid hand soap, a liquid facial cleanser, a liquid facial toner, a moisturizer, and the like) during shipping and commercialization of such product, or even during usage after such product has been sold. In situ mixing of the present invention is particularly distinguished from the in-line mixing that occurs inside one or more liquid pipelines that are positioned upstream of the container, and preferably upstream of the filling nozzle(s). In situ mixing is also distinguished from the batch mixing that occurs inside one or more mixing/storage tanks that are positioned upstream of the liquid pipelines leading to the container.

The liquid filling system of the present invention is particularly suitable for subsequently filling the container with a major feed composition (e.g., containing one or more surfactants, solvents, builders, structurants, polymers, perfume microcapsules, pH modifiers, viscosity modifiers, etc.), after a minor feed composition (e.g., containing one or more perfumes including perfume microcapsules, colorants, opacifiers, pearlescent aids such as mica, titanium dioxide coated mica, bismuth oxychloride, and the like, enzymes, brighteners, bleaches, bleach activators, catalysts, chelants, polymers, etc.) has already been filled into such container. Preferably, the major and minor feed compositions are significantly different from each other in viscosity, solubility, and/or miscibility, and it is difficult to form homogenous mixture of these two compositions through in situ mixing. More preferably, the minor feed composition is prone to form hard-to-remove residues on certain regions on the interior surfaces of the container, due to the physical/chemical characteristics of the minor feed composition and/or due to the shape/surface properties of the container. A key feature of the liquid filling system of the present invention is to enable filling of the major feed composition in such a manner as to minimize formation of minor feed residues and to optimize the in situ mixing result.

FIG. 1 shows an exemplary liquid filling system 10 according to one embodiment of the present invention, which includes a container 20 and a nozzle 30.

The container according to the present invention is a container that is specifically designated for housing a finished liquid consumer product during shipping and commercialization of such product, or even during usage after such product has been sold. Suitable containers may include pouches (especially standup pouches), bottles, jars, cans, cartons that are water-proof or water-resistant, and the like.

Figure 2A:
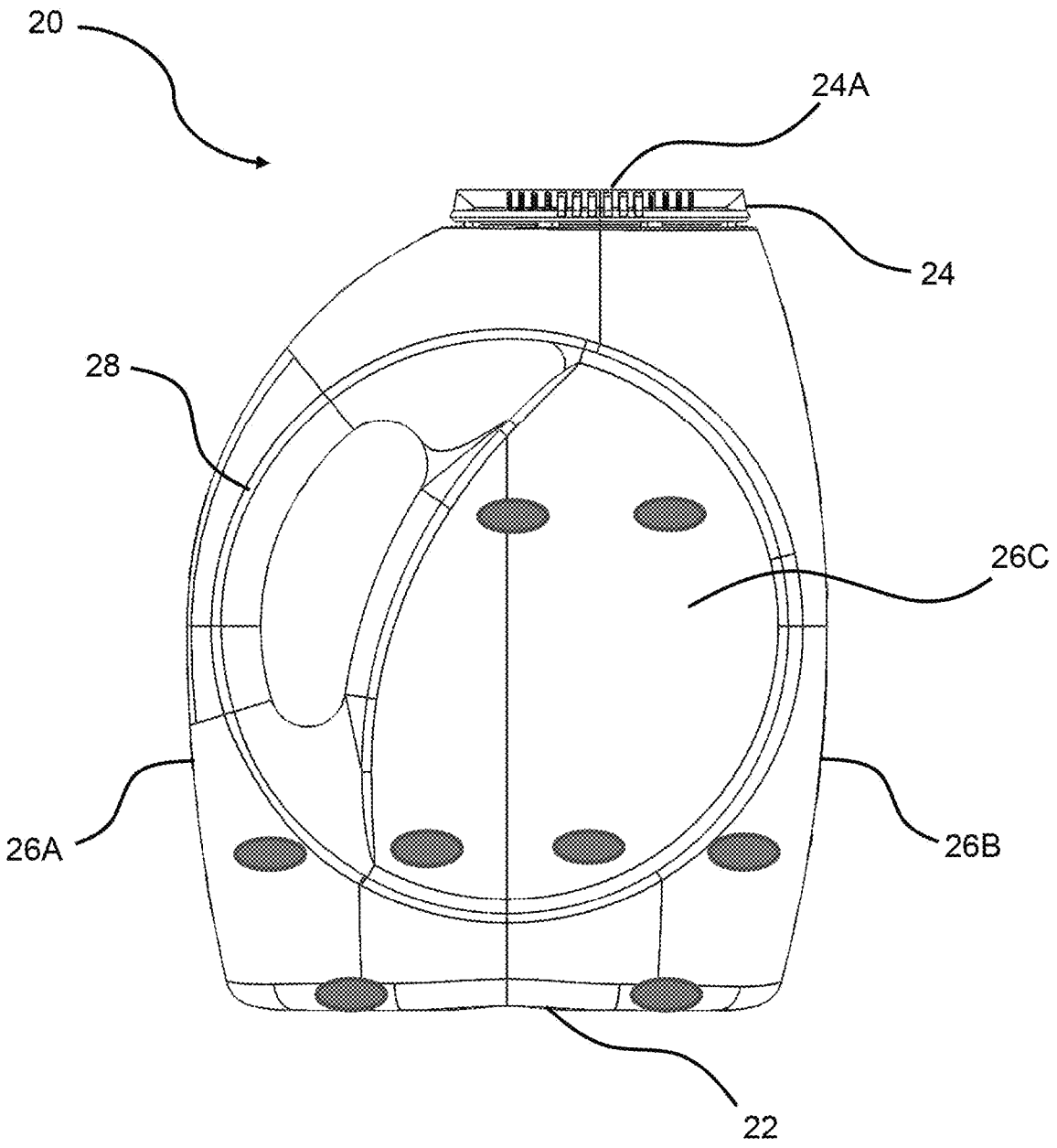
FIG. 2A is a front view of the container from FIG. 1.
Figure 2B:
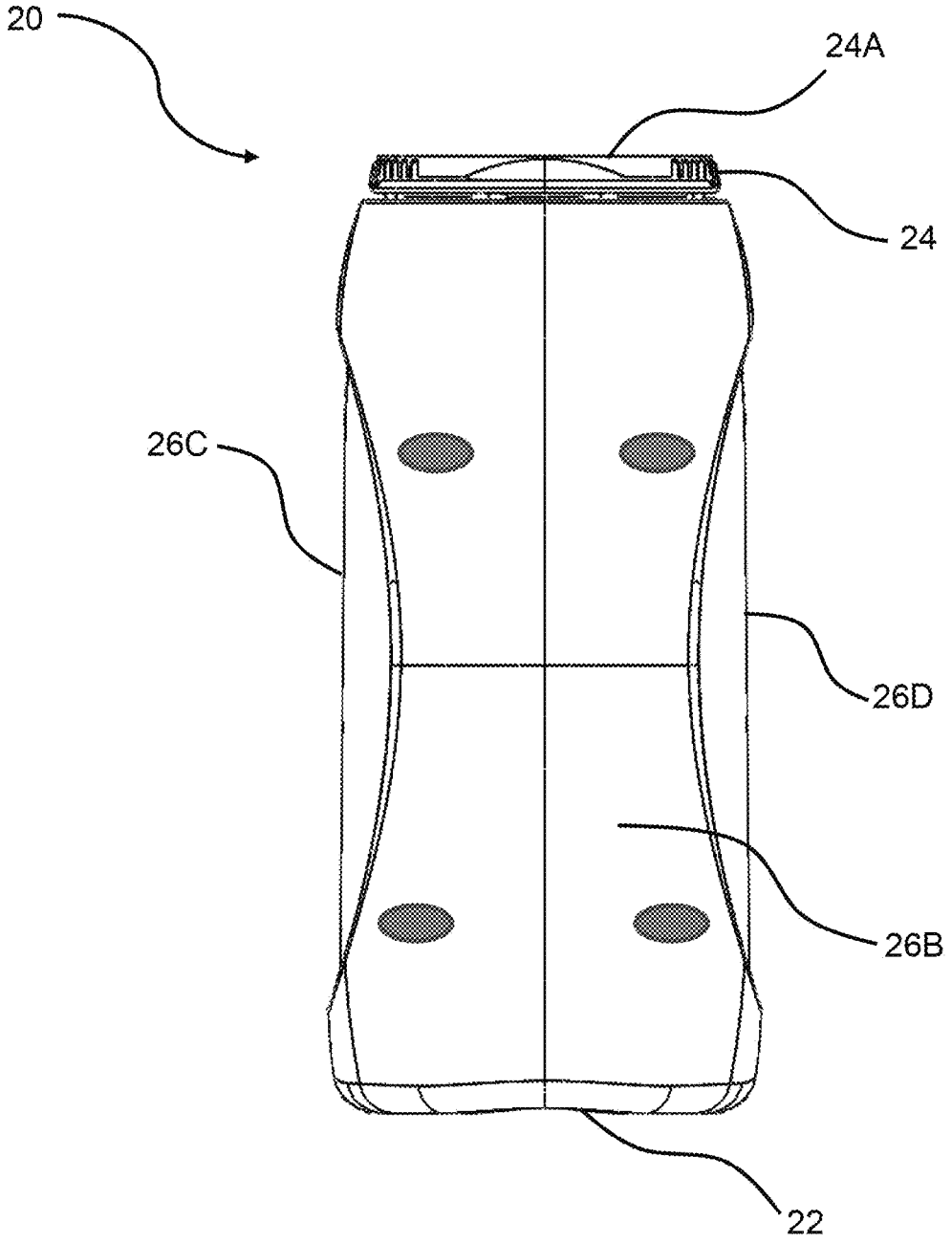
FIG. 2B is a right sideview of the container from FIG. 2A.
Figure 2C:
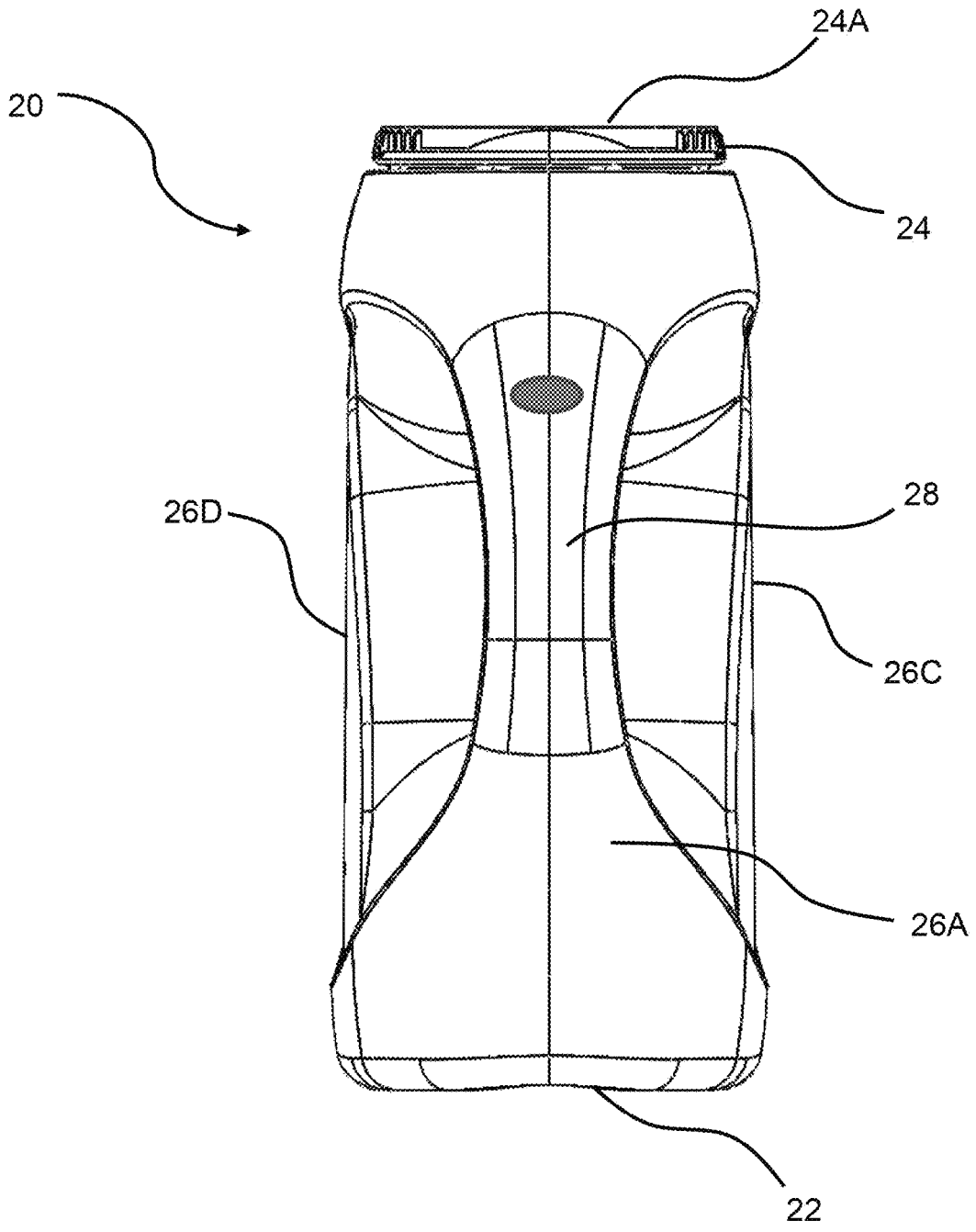
FIG. 2C is a left sideview of the container from FIG. 2A.
Figure 3A:
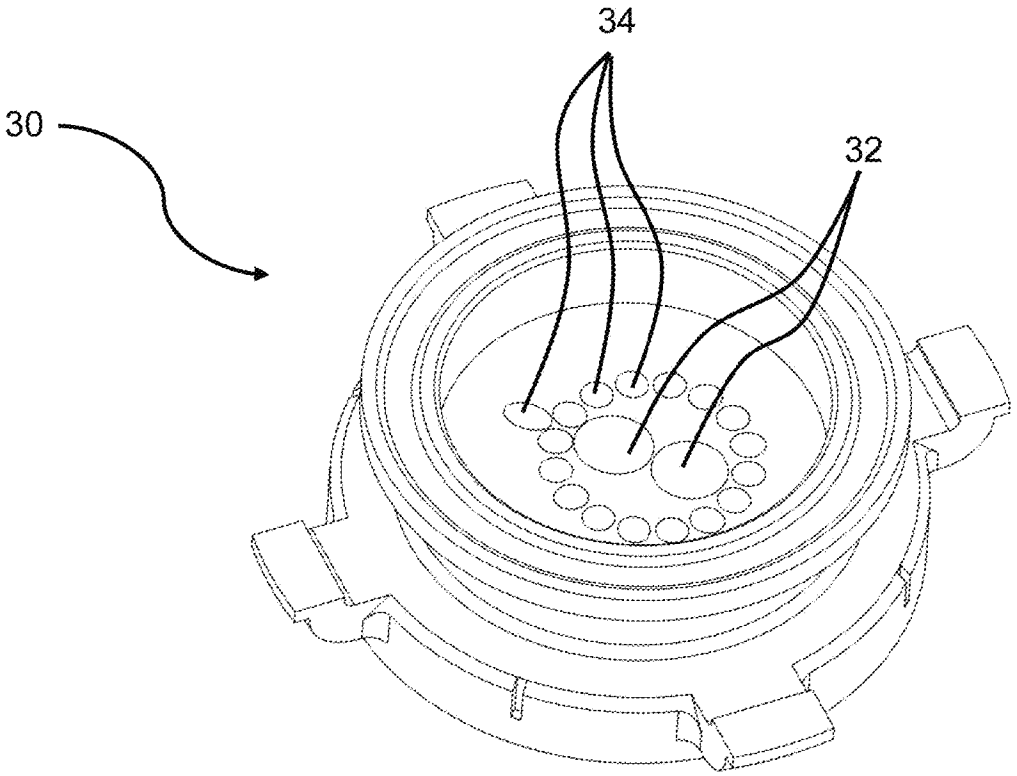
FIG. 3A is a perspective view of the nozzle from FIG. 1.
Figure 3C:
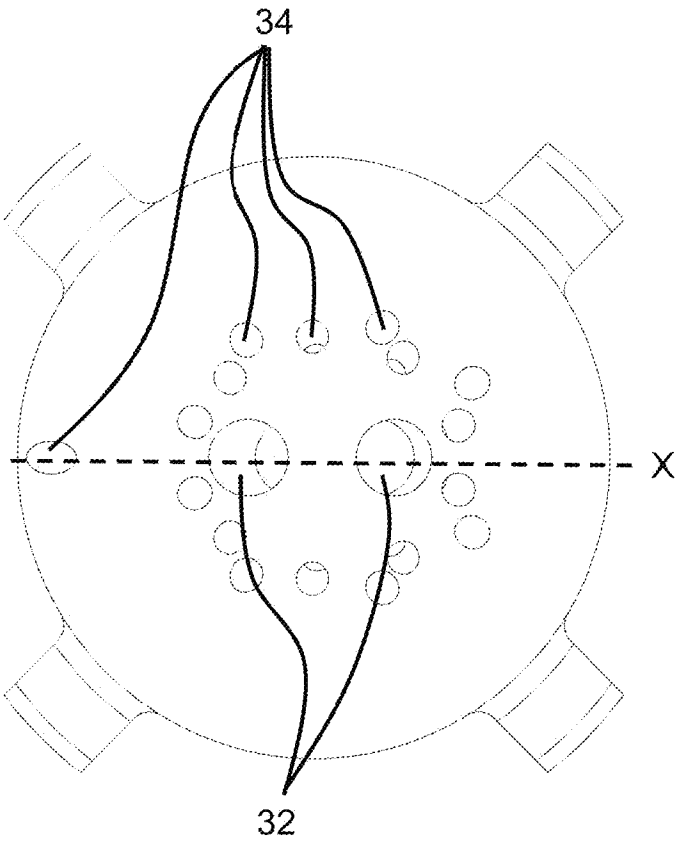
FIG. 3C is a bottom view of the nozzle from FIG. 3A.
Figure 3B:
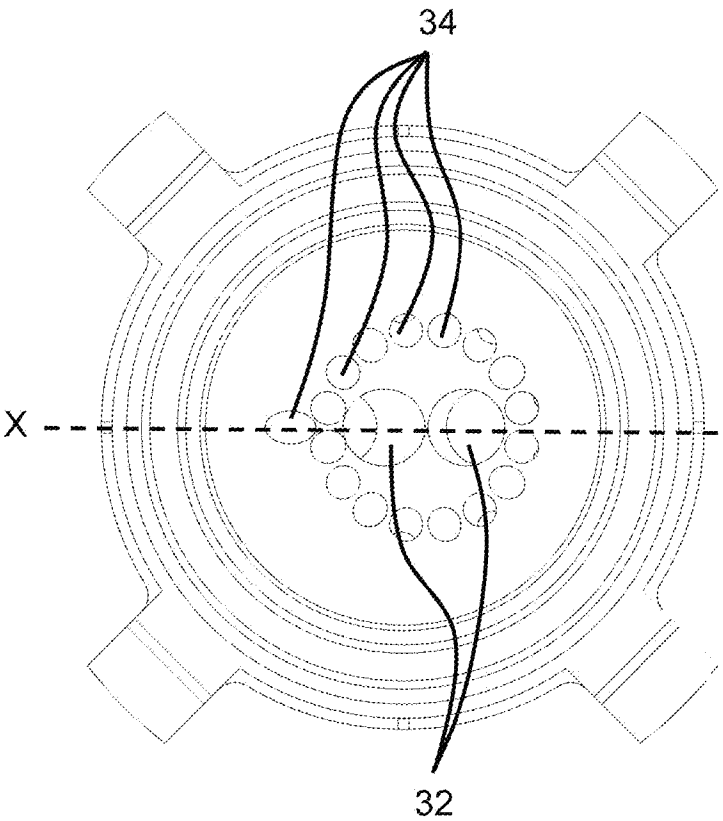
FIG. 3B is a top view of the nozzle from FIG. 3A.
Figure 3D:
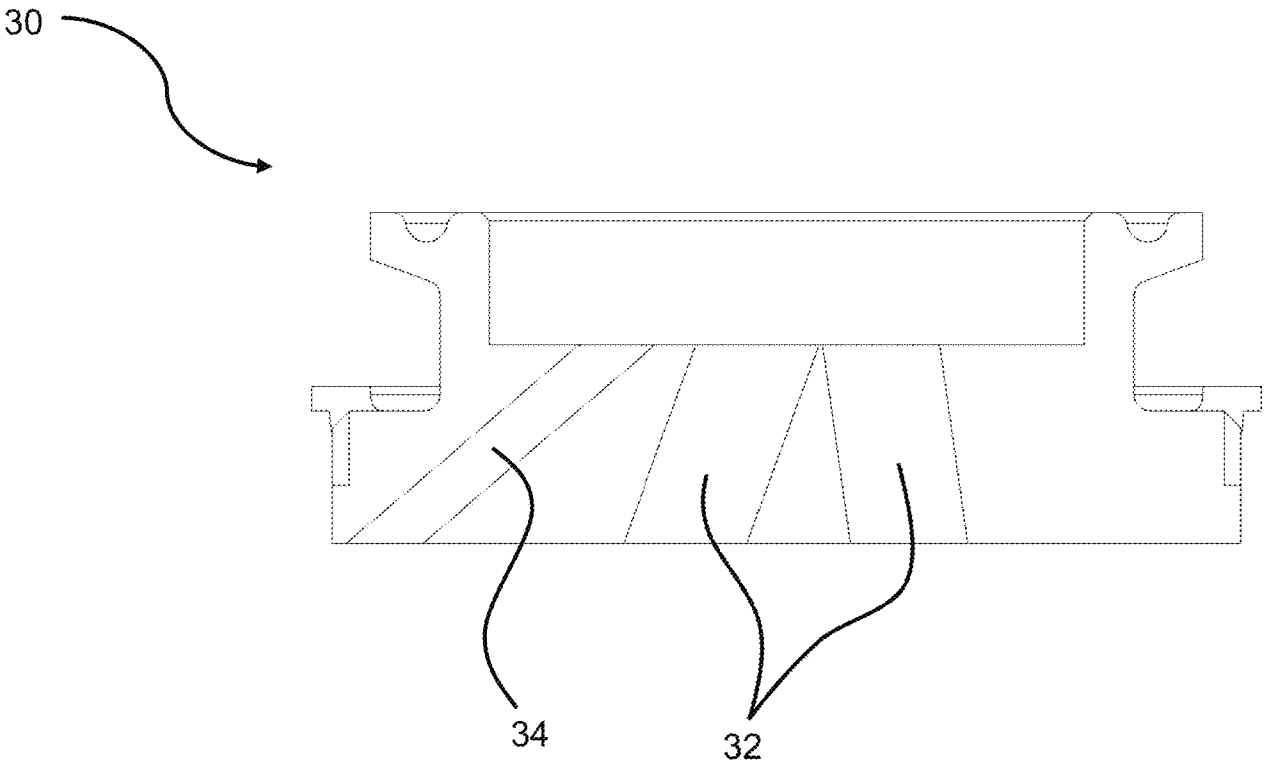
FIG. 3D is a cross-sectional view of the nozzle from FIGS. 3B and 3C along line X-X.

Specifically, the container 20 is a bottle having a bottom 22, a top 24, and one or more sidewalls between bottom 22 and top 24, which preferably include a left sidewall 26A, a right sidewall 26B, a front sidewall 26C, and a back sidewall 26D, as shown in FIGS. 2A-2C. Further, the container 20 may include a through handle 28 that connects the front sidewall 26C with the backside wall 26D, as shown in FIGS. 2A and 2C.

To improve the in situ mixing result and ensure that the major and minor feed compositions form a homogenous and stable mixture suitable for use as a consumer product, the liquid filling system of the present invention preferably includes/enables the following features during the filling of the major feed composition (following the filling of the minor feed composition):

- Generating a high top-to-bottom turbulence in the container as the main source of mixing energy to maximize the mixing between the minor feed composition already present in the container and the major feed composition being filled into the container;
- Targeting the liquid influxes formed by passing the major feed composition through the nozzle toward certain "hard-to-reach" regions on the container sidewalls, such as cracks and crevices on the container sidewalls or those zones characterized by relatively low or zero shear rate during the filing process, and certain "blind" regions in the container, such as the region at or near the through handle. This is especially critical because these regions, if not specifically targeted, can easily allow for the minor feed residues to build up and remain concentrated/unblended.
- Mating the container and the nozzle in a secure, repeatable fashion so the liquid influxes formed by the nozzle can accurately reach the targeted regions as mentioned hereinabove.

Correspondingly, the nozzle of the present invention is designed to include multiple liquid flow passages, including some configured to generate liquid influxes of the major feed composition that are directed toward the bottom of the container, and others configured to generate liquid influxes of the major feed composition that are directed toward the sidewall(s) of the container, as shown by the dashed arrowheads in FIG. 1. FIGS. 2A-2C shows various regions on the sidewalls of the container that are specifically targeted by multiple liquid influxes generated by the nozzle, as highlighted by the shaded circles.

FIGS. 3A-3D show a nozzle 30, which contain two first liquid flow passages 32 and a plurality of second liquid flow passages 34. Preferably, all or most of the first and second liquid flow passages 32 and 34 have offset inlets and outlets, so that these liquid flow passages are slanted or sloped with respect to a vertical direction, which correspondingly generates slanted or sloped liquid influxes of the major feed composition into the container 20, as shown by the dashed arrowheads in FIG. 1.

Specifically, the two first liquid flow passages 32 in the nozzle 30 are configured to generate two first liquid influxes of the major feed composition (not shown) that are targeted or directed toward two different regions at the bottom 22 of the container 20, as shown by the two shaded circles at the bottom 22 of the container 20 in FIG. 2A. Such first bottom-directed liquid influxes function to create a high top-to-bottom turbulence in the container 20 as the main source of mixing energy to maximize in situ mixing between the minor and major feed compositions in the container.

The plurality of second liquid passages 34 in the nozzle 30 are configured to generate multiple second liquid influxes of the major feed composition (not shown) that are targeted or directed toward different regions at the front/back sidewalls 26C and 26D, the right sidewall 26B, and the left sidewall 26A of the container 20, as shown by the multiple shaded circles on the sidewalls 26A-26D of the container 20 in FIGS. 2A-2C. These regions include certain "hard-to-reach" regions that are characterized by low or zero shear rate during filling (as shown in FIGS. 2A and 2B), and a "blind" region near the through handle 28 of the container 20 (as shown in FIG. 2C). Targeting of these regions on the sidewalls 26A-26D and at/near the through handle 28 of the container 20 effectively reduces or minimizes the minor feed residues built up on the interior surfaces of the container 20 and therefore further improves the in situ mixing between the minor and major feed compositions.

The first and second liquid flow passages 32 and 34 can be arranged in different manners, with different cross-sectional shapes, e.g., circular, semicircular, oval, square, rectangular, crescent, and combinations thereof.

The cross-sectional area ratio between each of the one or more first liquid flow passages 32 and each of the one or more second liquid flow passages 34 may range from about 1 to about 10, preferably from about 2 to about 8, more preferably from about 3 to about 7, most preferably from about 4 to about 6.

In a preferred but not necessary embodiment of the present invention, each of the first liquid flow passages 32 has a cross-sectional diameter or area that is significantly larger than that of each of the second liquid flow passages 34, so as to maximize the top-to-bottom liquid turbulence and increase the overall mixing energy. For example, the cross-sectional diameter of each of the one or more first liquid flow passages 32 is at least about 1.2 times greater, preferably at least about 1.5 times greater, more preferably at least about 2 times greater, most preferably at least about 2.2 times greater, than that of each of the second liquid flow passages 34. More preferably, each of the first liquid flow passages 32 has a cross-sectional area that is at least about 1.5 times greater, preferably at least about 3 times greater, more preferably at least about 5 times greater, than that of each of the second liquid flow passages 34.

In other embodiments of the present invention, each of the second liquid flow passages may have a cross-sectional area that is significantly larger than that of each of the first liquid flow passages, in order to accommodate an increased liquid flow. Further, the first and/or liquid flow passages can have different cross-sectional diameters or areas from each other, which can be employed to better target different regions inside an asymmetrical container. For example, one of the second liquid flow passages may have a cross-sectional diameter that is at least about 1.2 times greater, preferably at least about 1.5 times greater, more preferably at least about 2 times greater, most preferably at least about 2.2 times greater, than that of the other second liquid flow passages, and such larger second liquid flow passage may be configured to generate a larger liquid influx that specifically targets a significantly larger through handle region.

The nozzle of the present invention is preferably made as an integral piece, without any moving parts (e.g., O-rings, sealing gaskets, bolts or screws). Such an integral structure renders it particularly suitable for high speed filling of viscous liquid, which typically requires high filling pressure. Such a unitary nozzle can be made by any suitable material with sufficient tensile strength, such as stainless steel, ceramic, polymer, and the like. Preferably, the nozzle of the present invention is made of stainless steel.

The unitary nozzle of the present invention may have an average height ranging from about 3 mm to about 200 mm, preferably from about 10 to about 100 mm, more preferably from about 15 mm to about 50 mm. It may have an average cross-sectional diameter ranging from about 5 mm to about 100 mm, preferably from about 10 mm to about 50 mm, more preferably from about 15 mm to about 25 mm.

Preferably, the nozzles are pressurized during filling of the major feed composition, e.g., with an applied pressure ranging from about 0.5 bar to about 20 bar, preferably from about 1 bar to about 15 bar, and more preferably from about 2 bar to about 6 bar.

The total volume of the container may range from about 10 ml to about 10 L, preferably from about 20 ml to about 5 L, more preferably from about 50 ml to about 4 L. The minor feed composition (e.g., containing one or more perfumes including perfume microcapsules, colorants, opacifiers, pearlescent aids such as mica, titanium dioxide coated mica, bismuth oxychloride, and the like, enzymes, brighteners, bleaches, bleach activators, catalysts, chelants, polymers, etc.) is first filled into the container to occupy a minor volume of such container, e.g., 0.1-50%, preferably 0.1-40%, more preferably 1-30%, still more preferably 0.1-20%, and most preferably 0.1-10% of the total volume of the container. Subsequently, the major feed composition (e.g., containing one or more surfactants, solvents, builders, structurants, polymers, perfume microcapsules, pH modifiers, viscosity modifiers, etc.) is filled into the container via the nozzle of the present invention to occupy a major volume of such container, e.g., at least 50%, preferably at least 70%, more preferably at least 80%, and most preferably at least 90%, of the total volume of the container.

To ensure sufficient mixing of the major and minor feed compositions in such a container, it is preferred that the major feed liquid composition is filled at a significantly high speed so as to generate a sufficiently strong influx and turbulence in the container. Preferably, the major feed liquid composition is filled through the unitary nozzle as mentioned hereinabove at an average flow rate ranging from about 50 ml/second to about 10 L/second, preferably from about 100 ml/second to about 5 L/second, more preferably from about 500 ml/second to about 1.5 L/second. The minor feed liquid composition can be filled (by a different nozzle not shown or discussed here) at an average flow rate ranging from 0.1 ml/second to about 1000 ml/second, preferably from about 0.5 ml/second to about 800 ml/second, more preferably from about 1 ml/second to about 500 ml/second.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid filling system comprising:

a) a container comprising a bottom, a top, one or more sidewalls between the bottom and the top, and an opening at the top of the container;

b) a nozzle for filling said container with a liquid through the opening at the top of the container, wherein said nozzle comprises one or more first liquid flow passages with a cross-sectional diameter and one or more second liquid flow passages with a cross-sectional diameter, wherein said one or more first liquid flow passages are configured to generate one or more first liquid influxes that are directed toward the bottom of the container, wherein said one or more second liquid flow passages are configured to generate one or more second liquid influxes that are directed toward the sidewall(s) of the container, wherein the nozzle mixes in situ the one or more first liquid influxes and the one or more second liquid influxes.

2. The liquid filling system of claim 1, wherein said nozzle comprises a plurality of said first liquid flow passages configured to generate a plurality of said first liquid influxes directed at different regions of the bottom of the container.

3. The liquid filling system of claim 1, wherein said nozzle comprises a plurality of said second liquid flow passages configured to generate a plurality of said second liquid influxes directed at different regions of the sidewall(s) of the container.

4. The liquid filling system of claim 3, wherein said different regions of the sidewall(s) comprises at least a first region and a second region, and wherein said first region is closer to the bottom of the container than said second region.

5. The liquid filling system of claim 3, wherein said container further comprises a through handle that connects one sidewall of said container with another sidewall thereof, and wherein said different regions of the sidewall(s) comprises a region that is on or adjacent to the through handle of said container.

6. The liquid filling system of claim 4, wherein said container further comprises a through handle that connects one sidewall of said container with another sidewall thereof, and wherein said different regions of the sidewall(s) comprises a region that is on or adjacent to the through handle of said container.

7. The liquid filling system according to claim 1, wherein the cross-sectional area ratio between each of said one or more first liquid flow passages and each of said one or more second liquid flow passages is from 1 to 10.

8. The liquid filling system according to claim 7, wherein the cross-sectional area ratio between each of said one or more first liquid flow passages and each of said one or more second liquid flow passages is from 2 to 8.

9. The liquid filling system according to claim 8, wherein the cross-sectional area ratio between each of said one or more first liquid flow passages and each of said one or more second liquid flow passages is from 3 to 7.

10. The liquid filling system according to claim 9, wherein the cross-sectional area ratio between each of said one or more first liquid flow passages and each of said one or more second liquid flow passages is from 4 to 6.

11. The liquid filling system of claim 1, wherein the nozzle is an integral piece without any moving parts.

12. The liquid filling system of claim 1, wherein the nozzle is pressurized during filling with a pressure ranging from 2 bar to 6 bar.

13. The liquid filling system of claim 1, wherein the one or more first liquid influxes and the one or more second liquid influxes form a homogenious product.

14. The liquid filling system of claim 1, wherein the one or more first liquid influxes supply a liquid with a viscosity different than that supplied by the one or more second liquid influxes.

* * * * *